US006037759A

United States Patent [19]

Chen et al.

[11] Patent Number: 6,037,759

[45] Date of Patent: Mar. 14, 2000

[54] VOLTAGE REGULATOR CAPABLE OF IMPROVING SYSTEM RESPONSE

[75] Inventors: Juei-Lung Chen; Hsin-Pang Lu, both of Hsinchu, Taiwan

[73] Assignees: United Microelectronics Corp.; United Silicon Incorporated, both of Hsinchu, Taiwan

[21] Appl. No.: 09/392,879

[22] Filed: Sep. 9, 1999

[51] Int. Cl.[7] ..... G05F 1/44

[52] U.S. Cl. ..... 323/280; 330/260

[58] Field of Search ..... 323/273, 274, 323/275, 280; 330/253, 260, 291

[56] References Cited

U.S. PATENT DOCUMENTS

| | | | |
|---|---|---|---|
| 3,872,247 | 3/1975 | Saville et al. | 330/291 X |
| 5,387,822 | 2/1995 | Martin-Lopez et al. | 323/280 X |
| 5,548,205 | 8/1996 | Monticelli | 323/274 |

*Primary Examiner*—Jessica Han

*Attorney, Agent, or Firm*—Thomas, Kayden, Horstemeyer & Risley

[57] ABSTRACT

A voltage regulator capable of improving system response. The voltage regulator includes a feedback circuit and an operational amplifier. The input terminal of the feedback circuit is coupled to an output voltage terminal for attenuating signals coming out of the output terminal. The operational amplifier comprises a pre-amplifier, a clamping circuit and a power amplifier, all serially connected together. The input terminals of the pre-amplifier are respectively coupled to the output terminal of the feedback circuit and an input voltage terminal. The pre-amplifier is a device for amplifying differential voltage between input voltage signals and feedback voltage signals. The clamping circuit is a device for clamping amplified differential voltage from the pre-amplifier between a pre-defined voltage range. The power amplifier is a device for increasing the power of the differential voltage signals. The invention is able to maintain a quick response from the operational amplifier without reducing the frequency bandwidth of the amplifier.

4 Claims, 2 Drawing Sheets

VOLTAGE REGULATOR CAPABLE OF IMPROVING SYSTEM RESPONSE

BACKGROUND OF THE INVENTION

1. Field of Invention

The present invention relates to a voltage regulator. More particularly, the present invention relates to a voltage regulator capable of improving system response. The operational amplifier inside the voltage regulator is able to maintain a fast response without having to reduce the frequency bandwidth of the amplifier.

2. Description of Related Art

Conventionally, a voltage regulator is constructed using an operational amplifier (OP). To have a fast response, open circuit gain of the operational amplifier must increase. However, increasing the gain of the amplifier must be accompanied by a decrease in operational bandwidth, otherwise system instability may occur.

FIG. 1 is a block diagram of a conventional voltage regulator. As shown in FIG. 1, the voltage regulator 10 consists of an operational amplifier 12 and a feedback circuit 14. The operational amplifier 12 further includes a pre-amplifier 16 and a power amplifier 18. The pre-amplifier 16 is a signal integrator and an amplifier, and the power amplifier 18 is a device for increasing the power of incoming signals. There is also a large loading between the pre-amplifier circuit 16 and the power amplifier circuit 18. The feedback circuit 14 is a signal-attenuating device. The pre-amplifier 16 has two input terminals. One input terminal of the pre-amplifier 16 is connected to the output terminal of the feedback circuit 14, while the other input terminal is connected to an input voltage terminal $V_{IN}$. The input of the power amplifier 18 is coupled to the output terminal of the pre-amplifier 16. The output terminal of the power amplifier 18 is coupled to the input terminal of the feedback circuit 14 and an output voltage terminal $V_{OUT}$. In addition, one terminal of a load element 20 is coupled to the output voltage terminal $V_{OUT}$ while the other end is coupled to the ground GND.

Signals from the output voltage terminal $V_{OUT}$ are returned to the input terminal of the pre-amplifier 16 via the feedback circuit 14. Due to attenuation by the loading on the load element 20 and the feedback circuit 14, only a small fraction of the original output signal at the output terminal $V_{OUT}$ is returned to the pre-amplifier 16. The pre-amplifier 16 inside the operational amplifier 12 amplifies the differential voltage between signal at the input terminal $V_{IN}$ and the feedback signal. The amplified signal is fed to the large loading between the pre-amplifier 16 and the power amplifier 18. Finally, signal power is boosted up by the power amplifier 18 and output to the load element 20.

Because the signal has to pass through various load elements connected to the voltage regulator 10, speed of response for the operational amplifier 12 is reduced. However, to maintain the speed of response by increasing the operational bandwidth of the operational amplifier 12, the gain of the pre-amplifier 16 must be reduced. However, a reduction of the pre-amplifier gain reduces the capability of the pre-amplifier 16 for driving the power amplifier 18, thereby affecting the response of the entire system.

SUMMARY OF THE INVENTION

The invention provides a voltage regulator capable of improving system response.

To achieve this and other advantages and in accordance with the purpose of the invention, as embodied and broadly described herein, the invention provides a voltage regulator. The voltage regulator includes a feedback circuit and an operational amplifier. The input terminal of the feedback circuit is coupled to an output voltage terminal for attenuating signals coming out of the output terminal. The operational amplifier comprises a pre-amplifier, a clamping circuit and a power amplifier. The input terminals of the pre-amplifier are respectively coupled to the output terminal of the feedback circuit and an input voltage terminal. The pre-amplifier is a device for amplifying differential voltage between the input voltage signals and the feedback voltage signals. The input terminal of the clamping circuit is coupled to the output terminal of the pre-amplifier for clamping amplified differential voltage signals from the pre-amplifier within a pre-defined voltage range. The input terminal of the power amplifier is coupled to the output terminal of the clamping circuit. The output terminal of the power amplifier is coupled to the input terminal of the feedback circuit and the output voltage terminal. The power amplifier is a device for increasing the power of the differential voltage signals.

The voltage regulator of this invention speeds system response by introducing a clamping circuit between the pre-amplifier and the power amplifier of a conventional operational amplifier. Any signal that enters the clamping circuit is clamped within a pre-defined voltage range. Consequently, the open circuit gain of the operational amplifier is reduced and the frequency bandwidth of the operational amplifier is increased. Although the gain of the operational amplifier is reduced, gain of the pre-amplifier within the operational amplifier remains at the same level. Therefore, driving capability of the pre-amplifier for the power amplifier is not affected. Hence, system response speed will be not affected by the increase in frequency bandwidth of the operational amplifier. In other words, the invention is able to maintain response speed of the operational amplifier without a corresponding reduction in the frequency bandwidth of the operational amplifier.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
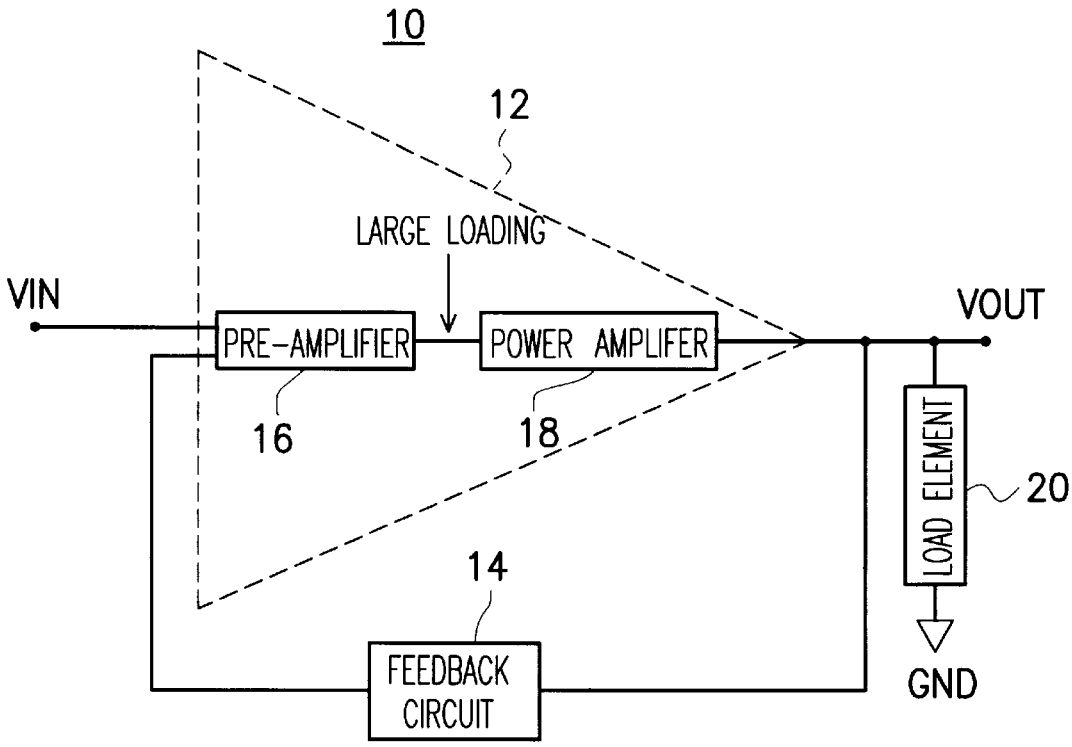
FIG. 1 (PRIOR ART)
FIG. 1 is a block diagram of a conventional voltage regulator.

Reference will now be made in detail to the present preferred embodiments of the invention, examples of which are illustrated in the accompanying drawings. Wherever possible, the same reference numbers are used in the drawings and the description to refer to the same or like parts.

Figure 2:
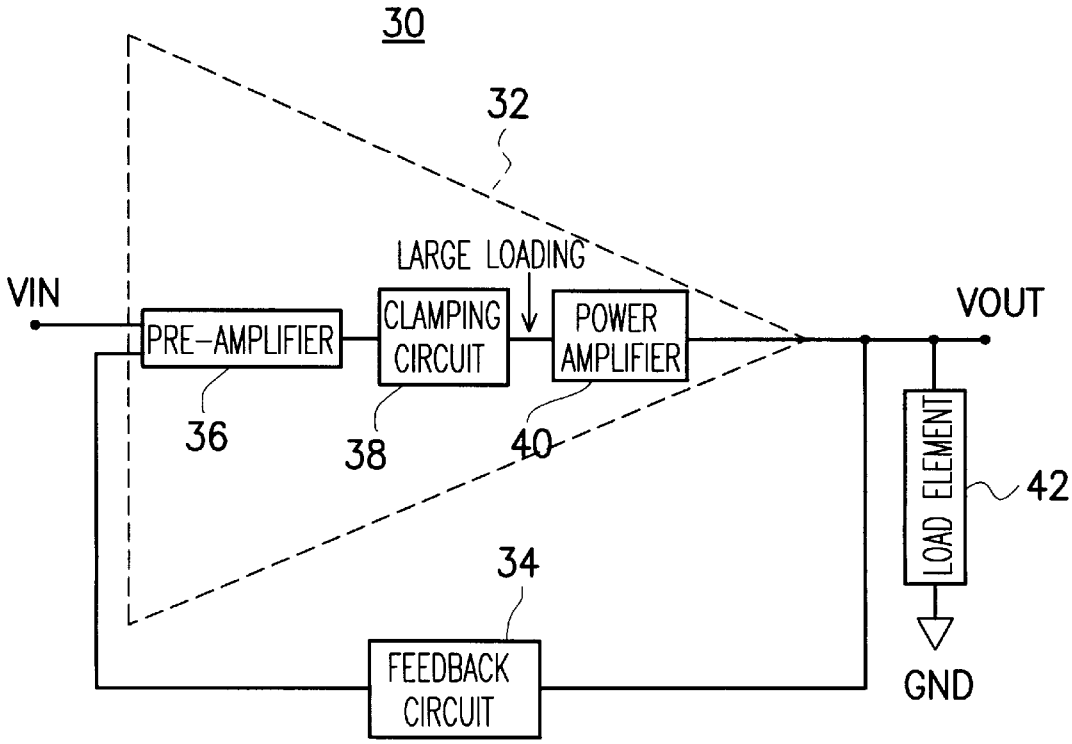
FIG. 2 is a block diagram showing a voltage regular according to one preferred embodiment of this invention.

FIG. 2 is a block diagram showing a voltage regular according to one preferred embodiment of this invention.

As shown in FIG. 2, the voltage regulator 30 of this invention includes an operational amplifier 32 and a feedback circuit 34. The operational amplifier 32 further includes a pre-amplifier 36, a clamping circuit 38 and a power amplifier 40. The pre-amplifier 36 is a signal integrator and an amplifier, the clamping circuit 38 is a device for clamping signals between a pre-defined voltage range, and the power amplifier 40 is for increasing the power of signals. There is also a large loading between the clamping circuit 38 and the power amplifier circuit 40. The feedback circuit 34 is a signal-attenuating device.

The pre-amplifier 36 inside the operational amplifier 32 has two input terminals. One of the input terminals of the pre-amplifier 36 is connected to the output terminal of the feedback circuit 34, while the other input terminal is connected to an input voltage terminal $V_{IN}$. The input terminal of the clamping circuit 38 is connected to the output terminal of the pre-amplifier 36, while the output terminal of the clamping circuit 38 is connected to the input terminal of the power amplifier 40. The output terminal of the power amplifier 40 is connected to the input terminal of the feedback circuit 34 and an output voltage terminal $V_{OUT}$. In addition, one terminal of a load element 42 is connected to the output voltage terminal $V_{OUT}$ while the other end is attached to a ground GND.

Figure 3:
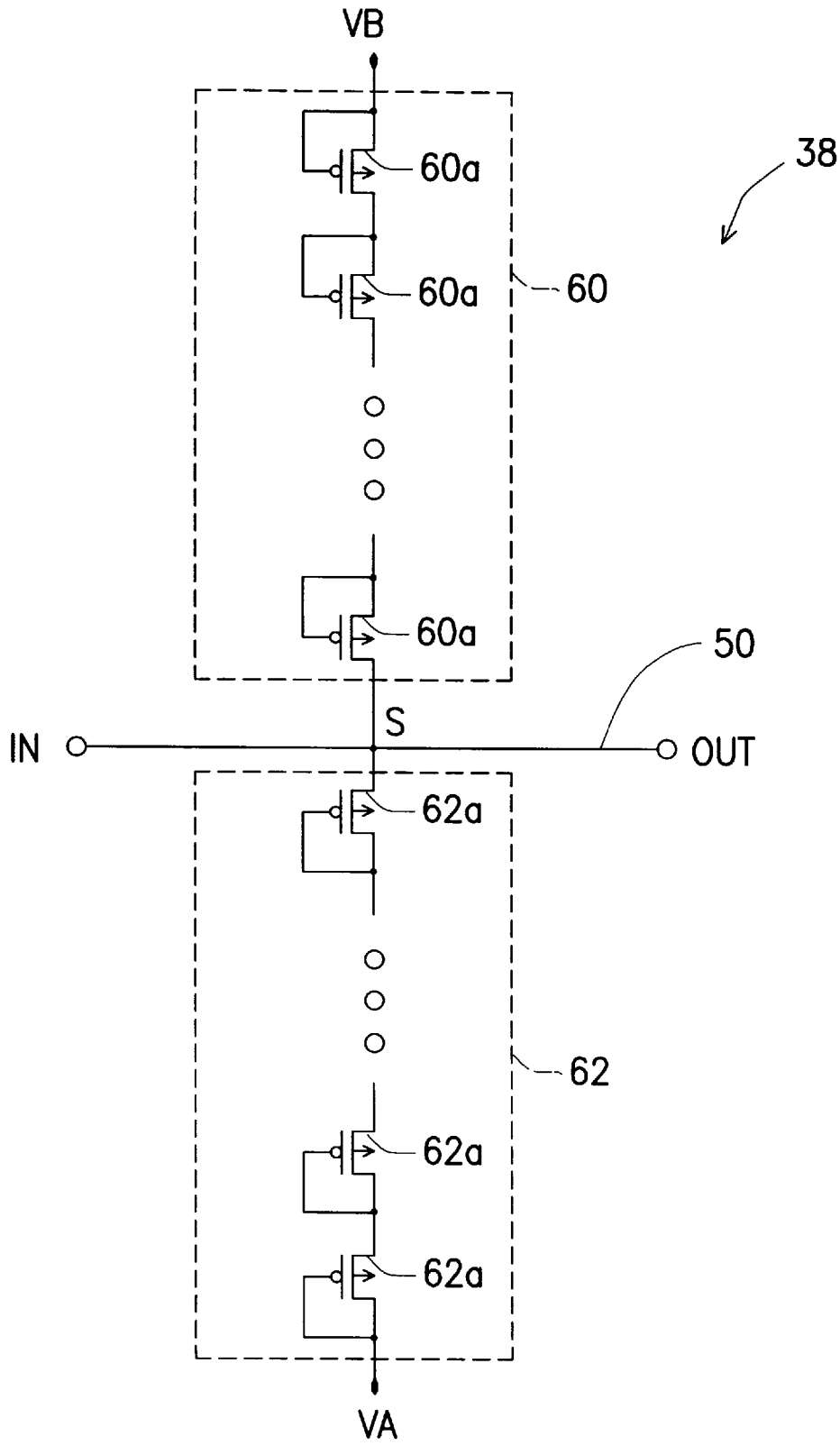
FIG. 3 is a circuit diagram of the clamping circuit associated with the voltage regulator of the invention.

The clamping circuit 38 can be implemented using the circuit shown in FIG. 3. As shown in FIG. 3, the clamping circuit 38 includes a first clamping element 60 and a second clamping element 62. The first clamping element 60 is formed, for example, by serially connecting m PMOS transistors 60*a* together, where m is an integer. Similarly, the second clamping element 62 is formed, for example, by serially connecting n PMOS transistors 62*a* together, where n is an . One end of the first clamping element 60 is coupled to a voltage source VB while the other end is coupled to a node point S on the signal line 50. One end of the second clamping element 62 is coupled to a voltage source VA while the other end is coupled to the same node point S on the signal line 50. Furthermore, the terminal IN is the input terminal of the clamping circuit 38, while the terminal OUT is the output terminal of the clamping circuit 38.

Through the clamping circuit 38 as shown in FIG. 3, incoming signals are clamped between the voltage range of VA+nVtp to VB−mVtp, where Vtp represents the threshold voltage of the PMOS transistors 60*a* and 62*a*. The clamping circuit 38 can also be constructed using NMOS transistors instead of PMOS transistors 60*a* and 62*a*.

Signals from the output voltage terminal $V_{OUT}$ are returned to the input terminal of the pre-amplifier 36 via the feedback circuit 34. Due to attenuation by the loading on the load element 42 and the feedback circuit 34, only a small fraction of the original output signal at the output terminal $V_{OUT}$ is returned to the pre-amplifier 36. The pre-amplifier 36 amplifies the differential voltage between the signal at the input terminal $V_{IN}$ and the feedback signal. The amplified signal next passes through the clamping circuit 38 so that the output signal from the clamping circuit 38 is permitted to vary within a pre-defined voltage range. The signal is fed to the large loading between the clamping circuit 38 and the power amplifier 40. Finally, signal power is boosted up by the power amplifier 40 and output to the load element 42.

Since signals are clamped within a pre-defined voltage range after passing through the clamping circuit 38, open circuit gain of the operational amplifier 32 is reduced and frequency bandwidth is increased. Although the output gain of the operational amplifier 32 is reduced and frequency bandwidth is increased, capability of the pre-amplifier 36 for driving the power amplifier 40 can be maintained because gain of the pre-amplifier remains the same. Hence, response speed of the entire system can be maintained despite a reduction of frequency bandwidth.

In summary, the voltage regulator of this invention is able to speed system response by introducing a clamping circuit between the pre-amplifier and the power amplifier of a conventional operational amplifier. Signal that enters the clamping circuit is clamped within a pre-defined voltage range. Consequently, the open circuit gain of the operational amplifier is reduced and the frequency bandwidth of the operational amplifier is increased. Although the gain of the operational amplifier is reduced, gain of the pre-amplifier within the operational amplifier remains the same. Therefore, driving capability of the pre-amplifier for the power amplifier is not affected. Hence, system response speed will be not affected by the increase in frequency bandwidth of the operational amplifier. In other words, the invention is able to maintain response speed of the operational amplifier without a corresponding reduction in the frequency bandwidth of the operational amplifier.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage regulator capable of improving system response, comprising:

a feedback circuit whose input terminal is coupled to an output voltage terminal for attenuating the output signal; and an operational amplifier, including:

a pre-amplifier whose input terminals are coupled to the output terminal of the feedback circuit and an input voltage terminal, respectively, wherein the pre-amplifier is a device for amplifying the differential voltage between the feedback output voltage signal and the input voltage signal;

a clamping circuit whose input terminal is coupled to the output terminal of the pre-amplifier, wherein the clamping circuit is a device for clamping differential voltage signals between a pre-defined voltage range; and a power amplifier whose input terminal is coupled to the output terminal of the clamping circuit while the output terminal is coupled to both the input terminal of the feedback circuit and the output voltage terminal, wherein the power amplifier is a device for increasing the power output of differential voltage signals.

2. The voltage regulator of claim 1, wherein the clamping circuit includes:

a signal line having a first terminal and a second terminal such that the first terminal is coupled to the output terminal of the pre-amplifier while the second terminal is coupled to the input terminal of the power amplifier;

a first clamping element having a first terminal connected to a first voltage source VB and a second terminal connected to the signal line such that the first clamping element is able to clamp when a first voltage level is reached; and a second clamping element having a first terminal connected to a second voltage source VA and a second terminal connected to the signal line such that the second clamping element is able to clamp when a second voltage level is reached, wherein the clamping circuit is able to clamp signals outside the voltage range set by the first and the second clamping element.

3. The voltage regulator of claim 2, wherein the first clamping element is constructed using m serially connected PMOS transistors and the second clamping element is constructed using n serially connected PMOS transistors, where m and n are integers so that the first and second voltage level are set to VB−mVtp and VA+nVtp, lo respectively, with Vtp representing the threshold voltage of each PMOS transistor.

4. The voltage regulator of claim 2, wherein the first clamping element is constructed using m serially connected NMOS transistors and the second clamping element is constructed using n serially connected NMOS transistors, where m and n are integers.

* * * * *